United States Patent [19]

Castegnier

[11] 3,987,616

[45] Oct. 26, 1976

[54] DIGITAL WATCH TIME SETTING SYSTEM

[76] Inventor: Guy Castegnier, 440 Abelard app. N, Ile des Soeurs, Quebec, Canada

[22] Filed: June 5, 1975

[21] Appl. No.: 584,169

[52] U.S. Cl. ..... 58/23 C; 58/50 R; 58/85.5

[51] Int. Cl.[2] ..... G04B 27/08; G04C 3/00

[58] Field of Search ..... 58/23 R, 23 A, 23 AC, 58/23 C, 50 R, 50 A, 85.5

[56] References Cited

UNITED STATES PATENTS

| | | | |
|---|---|---|---|
| 3,485,033 | 12/1969 | Langley | 58/23 R |
| 3,541,779 | 11/1970 | Langley | 58/23 R X |

*Primary Examiner*—Stanley J. Witkowski

[57] ABSTRACT

In digital watches including a timing circuit driven by a crystal controlled oscillator. The timing circuit provides drive signals for powering a digital time display. An updating and time setting circuit is provided to vary or adjust the time displayed by means of photo-responsive devices supplying, when actuated, a voltage signal to the timing circuit, then modifying the drive signals and thereby selectively varying the time set on the digital display. The photo-responsive devices may be photo-diodes, photo-transistors or photovoltaic cells. A plate is rotatably mounted on the casing back or side of the watch, which plate is provided with an opening to allow light rays to impinge upon one of the photo-responsive devices through a corresponding window provided in the watch casing, whenever the window and the opening are in registration.

5 Claims, 5 Drawing Figures

DIGITAL WATCH TIME SETTING SYSTEM

Figure 1:
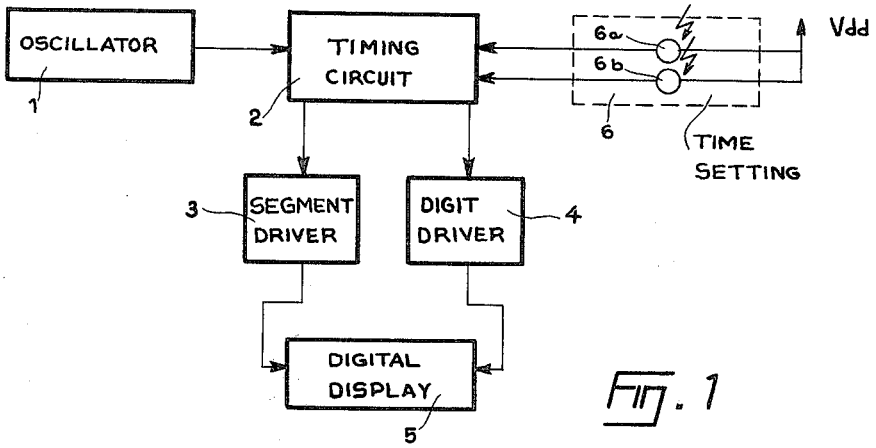

The present invention relates to electronic digital watches and more particularly to means for display updating and time setting.

Currently available numerical watches incorporate up-to-date integrated circuit or micropower technology and are generally made up of a crystal controlled input stage driving a chip timing circuit comprising a divider chain to step down the crystal frequency to a required 1 Hz, and logic configurations to properly sequence digit and segment display driver circuits to power the numerical display, the latter being usually of the light emitting diode or liquid crystal type.

As with the traditional mechanical time piece watches, several means have been devised to update and set the time displayed on electronic watches. Generally outlined, in now available electronic watches, updating and time setting are effected through manual actuation of mechanical switches by pressing, pulling or turning a button projecting from the watch casing. Thus, whenever the proper button switch is actuated a signal energized the timing circuit to hold counting of hours, minutes or seconds by disabling the appropriate second, minute or hour divider circuit. Such mechanical switch button usually extends through the side of the watch casing and therefore humidity as well as dust particles may get into the casing through the corresponding button hole, thereby corroding the switch contacts as well as affecting the electronic circuit itself. Moreover, an excessive pressure onto the switch button may severely damage the parts inside the watch.

In an attempt to overcome the drawbacks of the mechanical switches, reed switches embodied into the electronic circuit, inside the watch casing have been proposed. To open the reed switch contacts, a permanent magnet is supplied with the watch, which magnet produces a magnetic field sufficient to actuate the the switch through the watch casing. The reed-switch-permanent-magnet mechanism is indeed superior to the mechanical switch system, but presents a major inconvenience: the reed switches are very fragile and may break under medium hard shocks. Moreover, those switches are very sensitive to circuit internal magnetic fields as well as external magnetic fields.

A prime object of the present invention consists in avoiding the above-noted drawbacks affecting the up-to-now updating and time setting mechanism through the use of solid state switches instead of the prior art mechanical and reed switches. This object is achieved by providing photo-responsive switches which whenever exposed to light will instantly feed the timing circuit with the appropriate time setting signal.

Another object of the present invention resides in providing windows through the casing of the watch, one window for each photo-responsive device, so as to allow the light to actuate such devices without leaving whatsoever path for dust particles or humidity, thereby avoiding external sources which may disturb the watch operation as well as preventing deterioration of the electronic watch circuits. It is appreciated that the windows may be located anywhere in the watch casing respecting the design and the layout of the watch.

Figure 2A:
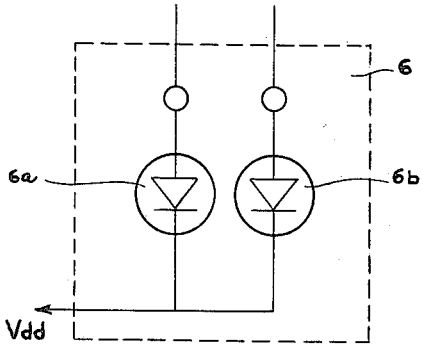
Figure 2B:
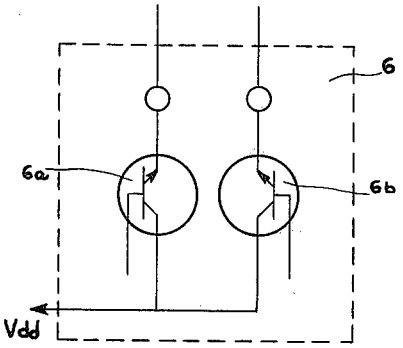
Figure 3A:
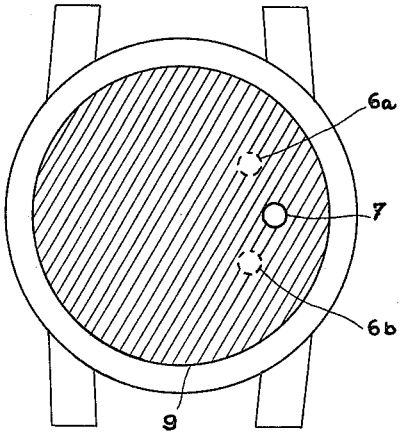
Figure 3B:
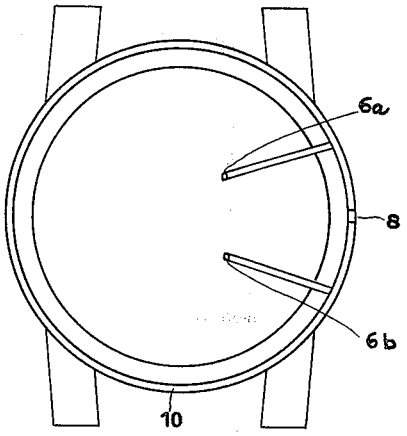

Preferred embodiments of the present invention will be hereinafter described with reference to the accompanying drawings, wherein:

FIG. 1 shows the improved updating and time setting device in accordance with the present invention incorporated into a typical electronic watch circuit;

FIGS. 2*a* and 2*b* illustrate, respectively, two types of photo-responsive devices used in the updating and time setting circuit shown in FIG. 1;

FIGS. 3*a* and 3*b* show respectively the windows mounted at the back and side of the electronic watch.

FIG. 1 generally illustrates a typical electronic watch circuit configuration incorporating the updating and time setting device in accordance with the present invention. Several electronic watch circuits have been proposed and some of them are more specifically described in the biweekly publication "Electronics" of Dec. 12, 1974, pages 96 to 104, by Walker and Altman, published by McGraw Hill, New York. The design as such of those electronic circuits is of remote concern with the present invention, but may be described as generally comprising an oscillator stage 1, usually a 32,768 Hz crystal oscillator, which feeds a timing circuit 2 including a divider chain to step down the crystal frequency to the required 1 Hz and logic configurations which properly sequence the segment driver 3 and digit driver 4 to power respectively the segments and digits of the digital display 5. In most electronic watch circuits, the timing circuit is constituted of a single chip and is made following a low threshold ion implanted C-MOS metal gate process. The crystal controlled oscillator frequency is usually divided through a 15-stage divider to provide drive signals to the digital display which may be of the liquid crystal or light emitting diode type. The chip timing circuit in general operates from a single or double 2 to 5 V supply.

FIG. 1 shows the updating and time setting circuit 6 according to the present invention for energizing in a known manner the timing circuit 2 with a voltage V*dd* in order to cause variation of the appropriate segments and digits of the display 5. The display time setting circuit 6 is made up of photo-responsive devices designated by 6*a* and 6*b* which when exposed to light rays energize the timing circuit 2 with the voltage V*dd* for varying the time set on display 5, one photo-responsive device being effective in updating the minute, the other in changing the hour digits and segments. Although only two photo-responsive devices are illustrated in FIG. 1, obviously other photo-conductive devices may be added to perform in the same fashion variations of the seconds and dates appearing on the digital display 5.

In FIGS. 2*a* and 2*b*, there are shown two types of photo-responsive devices preferably employed within the scope of the present invention. The light responsive photo-diodes, FIG. 2*a*, as well as photo-transistors, FIG. 2*b*, have been experimented and adequate results obtained. In any case, the timing circuit 2 has been energized with V*dd* and the time display 5 easily and readily powers to update the displayed hours, minutes, seconds or date, upon exposure to light of the corresponding photo-sensitive device. The photo-diode may be of the Germanium, Silicium or Silicon type whereas FET, Silicon, MOS photo-transistors may be used. Also, photovoltaic cells (not shown) may be advantageously used.

Moreover, the photo-responsive devices may be incorporated into the watch electronic circuit, thereby substantially reducing the compactness of the watch itself, which allows further variations in its design and layout.

As shown in FIGS. 3*a* and 3*b*, the photo-responsive devices 6*a* and 6*b* may be mounted either at the back or the side of the watch, respectively, the energizing light striking a device through a corresponding window provided in the casing of the watch. Thus, in FIG. 3*a*, a plate 9 is fixed to the back of the watch casing and rotated so as to bring an opening 7 provided therein in alignment with the responsive device 6*a* or 6*b* to feed the latter with the light rays required to actuate it. Similarly, the side mounted photo-responsive devices, shown in FIG. 3*b*, are individually actuated whenever the opening 8 provided in the crown plate 10 embracing the watch casing edge is aligned with the respective window. Each window is made up with a transparent material which is affixed to the watch casing by means of ultrasound process, for example.

In summary, the use of photo-responsive devices in accordance with the present invention, permits to achieve a digital display watch which is wholly dust-proof and humidity-proof and which is completely electronic, apart from any mechanical parts in the operation circuit of such solid state digital watch.

I claim:

1. In digital watches including a timing circuit driven by a crystal controlled oscillator, said timing circuit providing drive signals for powering a digital time display, the improvement comprising photo-responsive means supplying, when actuated, a voltage signal to said timing circuit to modify said drive signals and thereby to selectively vary the time set on said digital display; and a plate is mounted on the casing of the watch, said plate being provided with an opening to allow light rays to impinge upon one of said photo-responsive means through a corresponding window provided in the watch casing, whenever said window and said opening are in registration.

2. The improvement as claimed in claim 1, wherein said photo-responsive means are photo-diodes.

3. The improvement as claimed in claim 1, wherein said photo-responsive means are photo-transistors.

4. The improvement as claimed in claim 1, wherein said plate is rotatably mounted on the casing back of said watch.

5. The improvement as claimed in claim 1, wherein said plate is a crown plate embracing the casing edge of said watch.

* * * * *